US010971800B2

(12) United States Patent
Yun et al.

(10) Patent No.: US 10,971,800 B2
(45) Date of Patent: Apr. 6, 2021

(54) SURFACE-MOUNT ANTENNA APPARATUS AND COMMUNICATION SYSTEM HAVING THE SAME

(71) Applicant: TE CONNECTIVITY CORPORATION, Berwyn, PA (US)

(72) Inventors: Xing Yun, Harrisburg, PA (US); Christian Brandt, York, PA (US); John W. Hall, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 104 days.

(21) Appl. No.: 15/911,356

(22) Filed: Mar. 5, 2018

(65) Prior Publication Data

US 2019/0273305 A1 Sep. 5, 2019

(51) Int. Cl.

| | |
|---|---|
| ***H01Q 1/32*** | (2006.01) |
| ***H01Q 1/24*** | (2006.01) |
| ***H01Q 13/10*** | (2006.01) |
| ***H01Q 1/48*** | (2006.01) |
| ***H01Q 5/30*** | (2015.01) |
| ***H01Q 1/38*** | (2006.01) |
| ***H01Q 9/04*** | (2006.01) |
| ***H01Q 5/364*** | (2015.01) |
| ***H01Q 1/12*** | (2006.01) |

(52) U.S. Cl.

CPC ..... *H01Q 1/243* (2013.01); *H01Q 1/1207* (2013.01); *H01Q 1/3208* (2013.01); *H01Q 1/38* (2013.01); *H01Q 1/48* (2013.01); *H01Q 5/30* (2015.01); *H01Q 5/364* (2015.01); *H01Q 9/0421* (2013.01); *H01Q 13/10* (2013.01)

(58) Field of Classification Search

CPC .... H01Q 1/243; H01Q 1/1207; H01Q 1/3208; H01Q 1/48; H01Q 1/38; H01Q 9/0421; H01Q 5/364; H01Q 5/30; H01Q 13/10

See application file for complete search history.

(56) References Cited

U.S. PATENT DOCUMENTS

2003/0052827 A1* 3/2003 Umehara ..... H01Q 1/243 343/700 MS
2003/0174092 A1* 9/2003 Sullivan ..... H01Q 1/243 343/702

(Continued)

FOREIGN PATENT DOCUMENTS

WO 2002027859 A1 4/2002

OTHER PUBLICATIONS

International Search Report, International Application No. PCTIB2019/051566, International Filing Date, Feb. 27, 2019.

*Primary Examiner* — Awat M Salih

(57) ABSTRACT

Antenna apparatus includes a dielectric carrier having a first side and a second side. The antenna apparatus also includes a multi-band antenna having an interior surface and an exterior surface. The multi-band antenna includes a first section and a second section that are bent with respect to one another. The interior surface along the first and second sections defines a receiving space. The dielectric carrier is disposed within the receiving space such that the first section is positioned along the first side of the dielectric carrier and the second section is positioned along the second side of the dielectric carrier. The dielectric carrier includes at least one projection that covers a portion of the exterior surface of the multi-band antenna.

20 Claims, 6 Drawing Sheets

(56) References Cited

U.S. PATENT DOCUMENTS

| | | | | |
|---|---|---|---|---|
| 2003/0179144 | A1* | 9/2003 | Takesako | H01Q 1/243<br>343/702 |
| 2007/0126645 | A1 | 6/2007 | Yun et al. | |
| 2011/0043408 | A1* | 2/2011 | Shi | H01Q 1/48<br>343/700 MS |
| 2017/0170543 | A1* | 6/2017 | Lee | H01Q 1/2266 |

* cited by examiner

SURFACE-MOUNT ANTENNA APPARATUS AND COMMUNICATION SYSTEM HAVING THE SAME

BACKGROUND

The subject matter relates generally to antenna apparatuses configured to be installed with a carrier.

Antennas are increasingly requested and used for a number of applications within a variety of industries. Examples of such applications include mobile phones, wearable devices, portable computers, and communication systems for vehicles (e.g., automobiles, trains, planes, etc.). But there have been conflicting market demands for such antennas. Users and vendors request multi-band capabilities but would like the antennas to be smaller, hidden, and/or positioned at non-ideal locations, such as near other metal objects. Other constraints may include the requested bandwidth, available feed location, and the size of the ground plane to which the antenna may be mounted.

To meet these demands, manufacturers have attempted to optimize the antennas by reshaping components or by moving the components to different locations. Although these antennas can be effective in communicating wirelessly, alternative antennas which provide sufficient communication while occupying less space are still desired. In particular, it has become increasingly difficult to achieve a sufficient bandwidth for smaller antennas, while also providing an antenna that resists damage during installation and/or use.

Accordingly, there is a need for an antenna apparatus that has a sufficient bandwidth but occupies less space and is less susceptible to damage during installation or operation.

BRIEF DESCRIPTION

In an embodiment, an antenna apparatus is provided that includes a dielectric carrier having a first side and a second side. The antenna apparatus also includes a multi-band antenna having an interior surface and an exterior surface. The multi-band antenna includes a first section and a second section that are bent with respect to one another. The interior surface along the first and second sections defines a receiving space. The dielectric carrier is disposed within the receiving space such that the first section is positioned along the first side of the dielectric carrier and the second section is positioned along the second side of the dielectric carrier. The dielectric carrier includes at least one projection that covers a portion of the exterior surface of the multi-band antenna.

In some aspects, the at least one projection includes a locking projection that extends away from the dielectric carrier. The locking projection is configured to be deflected to allow the multi-band antenna to be positioned alongside the dielectric carrier. The locking projection includes a grip surface that covers the portion of the exterior surface. Optionally, the locking projection extends away from the second side.

In some aspects, the at least one projection includes a guide projection that is spaced apart from and extends along a surface of the dielectric carrier. The guide projection defines a slot between the guide projection and the surface of the dielectric carrier. The slot is sized to receive a thickness of a conductive sheet of the multi-band antenna. Optionally, the guide projection extends along the first side.

In some aspects, the at least one projection includes a locking projection that extends away from the dielectric carrier. The locking projection is configured to be deflected to allow the multi-band antenna to be positioned alongside the dielectric carrier. The locking projection includes a grip surface that covers the portion of the exterior surface. The at least one projection also includes a guide projection that is spaced apart from and extends along a surface of the dielectric carrier. The guide projection defines a slot between the guide projection and the surface of the dielectric carrier. The slot is sized to receive a thickness of a conductive sheet of the multi-band antenna. The guide projection extends along the first side and the locking projection extends away from the second side. The multi-band antenna is configured to be moved in a loading direction such that the first section is received within the slot and the second section deflects the locking projection.

In some aspects, the at least one projection includes multiple guide projections and multiple locking projections. The guide projections cover portions of a perimeter of the first section. The locking projections cover portions of a perimeter of the second section.

In some aspects, the first side of the dielectric carrier includes a ledge defining a platform space that is sized and shaped to receive the first section. The ledge interfaces with opposite side edges of the first section.

In some aspects, the multi-band antenna includes a feed terminal and a ground terminal. At least one of the feed and ground terminals extends around and grips a surface of the dielectric carrier.

In some aspects, the antenna apparatus has a height that is less than twenty millimeters.

In an embodiment, a communication system is provided that includes a printed circuit having a mounting side and a ground plane extending parallel to the mounting side. The communication system also includes an antenna apparatus secured to the mounting side of the printed circuit. The antenna apparatus includes a dielectric carrier having a first side and a second side. The antenna apparatus also includes a multi-band antenna having an interior surface and an exterior surface. The multi-band antenna includes a first section and a second section. The multi-band antenna is grounded to the ground plane. The interior surface along the first and second sections defines a receiving space. The dielectric carrier is disposed within the receiving space such that the first section is positioned along the first side of the dielectric carrier and the second section is positioned along the second side of the dielectric carrier. The dielectric carrier includes at least one projection that covers a portion of the exterior surface of the multi-band antenna.

In some aspects, the at least one projection includes a locking projection that extends away from the dielectric carrier. The locking projection is configured to be deflected to allow the multi-band antenna to be positioned alongside the dielectric carrier. The locking projection includes a grip surface that covers the portion of the exterior surface. Optionally, the locking projection extends away from the second side.

In some aspects, the at least one projection includes a guide projection that is spaced apart from and extends along a surface of the dielectric carrier. The guide projection defines a slot between the guide projection and the surface of the dielectric carrier. The slot is sized to receive a thickness of a conductive sheet of the multi-band antenna. Optionally, the guide projection extends along the first side.

In some aspects, the at least one projection includes a locking projection that extends away from the dielectric carrier. The locking projection is configured to be deflected to allow the multi-band antenna to be positioned alongside the dielectric carrier. The locking projection includes a grip surface that covers the portion of the exterior surface. The at least one projection includes a guide projection that is spaced apart from and extends along a surface of the dielectric carrier. The guide projection defines a slot between the guide projection and the surface of the dielectric carrier. The slot is sized to receive a thickness of a conductive sheet of the multi-band antenna. The guide projection extends along the first side and the locking projection extends away from the second side. The multi-band antenna is configured to be moved in a loading direction such that the first section is received within the slot and the second section deflects the locking projection.

In some aspects, the at least one projection includes multiple guide projections and multiple locking projections. The guide projections cover portions of a perimeter of the first section. The locking projections cover portions of a perimeter of the second section.

In some aspects, the first side of the dielectric carrier includes a ledge defining a platform space that is sized and shaped to receive the first section. The ledge interfaces with opposite side edges of the first section.

In some aspects, the multi-band antenna includes a feed terminal and a ground terminal. At least one of the feed and ground terminals extends around and grips a surface of the dielectric carrier.

In some aspects, the antenna apparatus has a height that is less than twenty millimeters.

DETAILED DESCRIPTION

Figure 1:
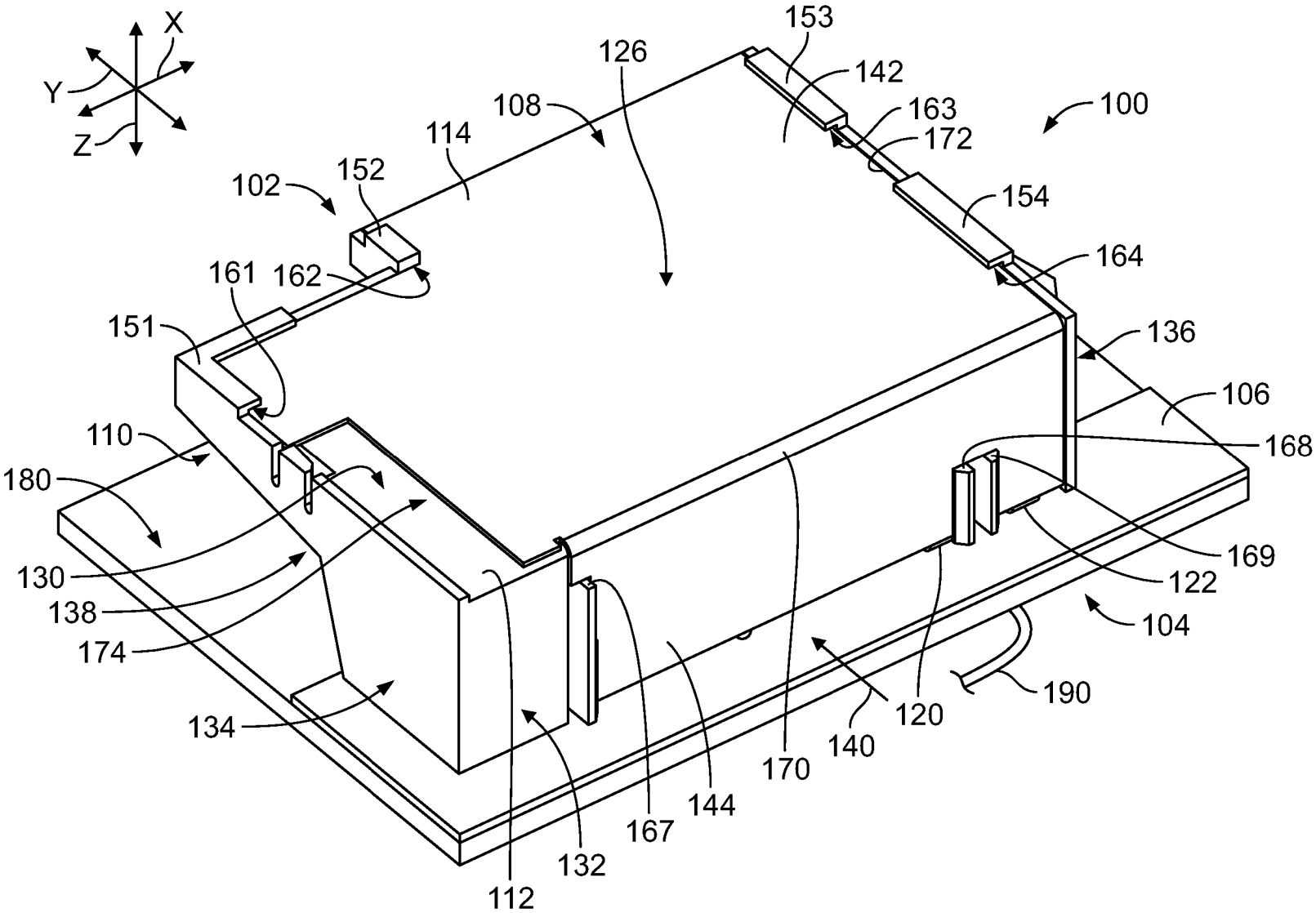
FIG. 1 is a perspective view of a communication system including an antenna apparatus formed in accordance with an embodiment.

Embodiments set forth herein include antenna apparatuses. The antenna apparatuses include a multi-band antenna and a dielectric carrier that is configured to support the multi-band antenna. The dielectric carrier includes one or more projections that clears or extend beyond the multi-band antenna and extends along an exterior side of the multi-band antenna to hold the multi-band antenna with respect to the dielectric carrier. For example, the multi-band antenna has an interior surface that extends along and faces the dielectric carrier. The multi-band antenna also has an exterior surface that faces away from the dielectric carrier and may represent an exterior of the antenna apparatus. The projections may project away from a main body of the dielectric carrier and over the exterior surface. The projections block the multi-band antenna from being inadvertently moved away from the dielectric carrier. When the dielectric carrier and the multi-band antenna are secured to one another, the two elements may form a modular structure that is configured to be moved, as a unit, for installation.

Optionally, the antenna apparatuses and/or the multi-band antennas may be "low-profile." For example, in certain embodiments, the multi-band antenna apparatus has a height that is no more than 20 millimeters. In some embodiments, the antenna apparatus may be part of a larger system. For example, the antenna apparatus may be part of a telematics unit positioned within, for example, a vehicle (e.g., automotive). It is contemplated, however, that embodiments set forth herein may have other sizes and/or other applications.

In the illustrated embodiment, the antenna apparatus includes a dielectric carrier that is molded from a thermoplastic material and a multi-band antenna that is stamped and formed from a conductive sheet. It should be understood, however, that the antenna apparatus may be manufactured through other methods, such as laser direct structuring (LDS), two-shot molding (dielectric with copper traces), and/or ink-printing. Conductive elements may be first formed and then a dielectric material may be molded around the conductive components. For example, the conductive elements may be stamped from sheet metal, disposed within a cavity, and then surrounded by a thermoplastic material that is injected into the cavity.

Embodiments may communicate within one or more radio-frequency (RF) bands. For purposes of the present disclosure, the term "RF" is used broadly to include a wide range of electromagnetic transmission frequencies including, for instance, those falling within the radio frequency, microwave, or millimeter wave frequency ranges. An RF band may also be referred to as a frequency band. An antenna apparatus may communicate through one or more RF bands (or frequency bands). In particular embodiments, the antenna apparatus communicates through multiple frequency bands. For example, in some embodiments, the antenna apparatus has one or more center frequencies within the range of surface mount (SMT) European Long-Term Evolution (LTE) bands, such as those within 0.4 GHz and 2.8 GHz. In particular embodiments, the antenna apparatus is configured to operate within the 790-950 MHz, 1700-1900 MHz, and 2500-2750 MHz.

It should be understood, however, that communication systems and antenna apparatuses described herein are not limited to particular RF bands and other RF bands may be used. Likewise, it should be understood that antenna apparatuses described herein are not limited to particular wireless technologies (e.g., LTE, WLAN, Wi-Fi, WiMax) and other wireless technologies may be used.

FIG. 1 is a perspective view of a communication system 100 formed in accordance with an embodiment. In an exemplary embodiment, the communication system 100 forms part of a larger system, such as a computer (e.g., desktop or portable), mobile phone, or a vehicle (e.g., automobiles, trains, planes). In certain embodiments, the communication system 100 is or forms part of a telematics unit positioned within a vehicle, such as an automotive.

The communication system 100 includes an antenna apparatus 102 and a printed circuit 104 having a mounting side 180. The antenna apparatus 102 is mounted onto the mounting side 180. The printed circuit 104 includes a ground plane 106. In other embodiments, the communication system 100 does not include a printed circuit and, instead, may have a discrete ground plane. The antenna apparatus 102 includes a multi-band antenna 108 and a dielectric carrier 110 that supports the multi-band antenna 108. More specifically, the dielectric carrier 110 and the multi-band antenna 108 may be shaped relative to one another so that portions of the multi-band antenna 108 are unsupported by the dielectric carrier 110. For example, the multi-band antenna 108 includes a conductive sheet 114 that is shaped to extend alongside an exterior support surface 112 of the dielectric carrier 110.

Although not shown, the communication system may include system circuitry having a module (e.g., transmitter/receiver) that decodes the signals received from the antenna apparatus 102 and/or transmitted by the antenna apparatus 102. In other embodiments, however, the module may be a receiver that is configured for receiving only. The system circuitry may also include one or more processors (e.g., central processing units (CPUs), microcontrollers, field programmable arrays, or other logic-based devices), one or more memories (e.g., volatile and/or non-volatile memory), and one or more data storage devices (e.g., removable storage device or non-removable storage devices, such as hard drives). The system circuitry may also include a wireless control unit (e.g., mobile broadband modem) that enables the communication system to communicate via a wireless network. The communication system may be configured to communicate according to one or more communication standards or protocols (e.g., LTE, Wi-Fi, Bluetooth, cellular standards, etc.).

During operation of the communication system 100, the communication system 100 may communicate through the antenna apparatus 102. To this end, the multi-band antenna 108 may include conductive elements that are configured to exhibit electromagnetic properties that are tailored for desired applications. For instance, the multi-band antenna 108 may be configured to operate in multiple RF bands simultaneously. The structure of the multi-band antenna 108 can be configured to effectively operate in particular RF bands. The structure of the multi-band antenna 108 can be configured to select specific RF bands for different networks. The multi-band antenna 108 may be configured to have designated performance properties, such as a voltage standing wave ratio (VSWR), gain, bandwidth, and a radiation pattern.

As shown, the antenna apparatus 102 is mounted onto the printed circuit 104. The ground plane 106 is positioned along a top side of the printed circuit 104 that is closest to the antenna apparatus 102. In other embodiments, however, the ground plane 106 may have a different level or depth within the printed circuit 104. In some embodiments, the ground plane 106 may have a relatively small profile. For example, an area of the ground plane may be embedded in the printed circuit.

As shown, the multi-band antenna 108 include a feed terminal 120 and a ground terminal 122. Each of the feed and ground terminals 120, 122 is configured to be electrically coupled to the printed circuit 104 through, for example, soldering.

The dielectric carrier 110 is configured to support and provide structural integrity to the multi-band antenna 108 so that the multi-band antenna is not inadvertently damaged during shipping, installation, and/or operation. As shown, the conductive sheet 114 of the multi-band antenna 108 includes an exterior surface 126 that is exposed to an exterior of the antenna apparatus 102. The dielectric carrier 110 is sized and shaped to extend immediately alongside an opposite interior surface 128 (shown in FIG. 2). As such, the dielectric carrier 110 may reduce the likelihood that the multi-band antenna 108 may become damaged during shipping, installation, and/or operation.

The dielectric carrier 110 includes a top or elevated side 130 that faces away from the printed circuit 104 and a side wall 132 that is at an angle with respect to the top side 130. For example, the side wall 132 may be perpendicular to the top side 130. The dielectric carrier 110 also includes opposite end sides 134, 136 that face in opposite directions with the top side 130 and the side wall 132 extending therebetween. The dielectric carrier 110 also includes an underside 138 that generally faces the printed circuit 104.

The dielectric carrier 110 is also configured to receive the multi-band antenna 108 in a manner that reduces the likelihood of damage to the multi-band antenna 108 when the multi-band antenna 108 is mounted to or loaded onto the dielectric carrier 110. For example, the multi-band antenna 108 may be oriented as shown in FIG. 1 and moved toward the dielectric carrier 110 in a loading direction 140. The conductive sheet 114 includes an elevated section 142 and an upright section 144.

During the loading operation, the elevated section 142 of the multi-band antenna 108 may slide along the top side 130 of the dielectric carrier 110, and an upright section 144 of the multi-band antenna 108 may move toward and eventually abut the side wall 132 of the dielectric carrier 110. The elevated section 142 and the upright section 144 couple to each other along a fold line 170 and are oriented perpendicular to one another in the illustrated embodiment. In other embodiments, however, the elevated section 142 and the upright section 144 may form different angles with respect to one another. As such, the elevated section 142 and the upright section 144 are bent with respect to one another. An angle that may be defined by the elevated section 142 and the upright section 144 may be, for example, 90°+/−20°. In particular embodiments, the angle has a range of 90°+/−10° or a range of 90°+/−5°. As the elevated section 142 slides along the top of dielectric carrier 110, the elevated section 142 may slide through slots 161-164 defined by guide projections 151-154 of the dielectric carrier 110. The guide projections 151-154 are shaped to extend along but spaced apart from the top side 130, thereby defining the slots 161-164 between the top side 130 and the guide projections 151-154. The guide projections 151-154 may guide the elevated section 142 during the loading operation and prevent the elevated section 142 from being inadvertently pulled away from the dielectric carrier 110 during operation.

The dielectric carrier 110 is also configured to hold the multi-band antenna 108 in an essentially fixed position relative to the dielectric carrier 110 and prevent the multi-band antenna 108 from being inadvertently removed. For example, the dielectric carrier 110 includes a plurality of locking projections 167, 168, 169. The locking projections 167, 168, and 169 project from the side wall 132. In the illustrated embodiment, the locking projections 167-169 are latches that are configured to be deflected by the multi-band antenna 108 and, upon clearing the multi-band antenna 108, moving back toward an undeflected position to grip the multi-band antenna 108 along the side wall 132.

The dielectric carrier 110 may also include a ledge 172 that defines a platform space 174. The platform space 174 may be sized and shaped to receive the elevated section 142 of the multi-band antenna 108. For example, the ledge 172 may interface opposite side edges of the elevated section 142. The ledge 172 interfaces with the elevated section 142 if the ledge 172 directly engages or is immediately adjacent to the side edges of the elevated section 142. As such, the ledge 172 holds the multi-band antenna 108 in an essentially fixed position along the X-axis and the elevated side 130 the side wall 132, and the projections 151-154 and 167-169 hold the multi-band antenna apparatus 102 in an essentially fixed position along the Y-axis and Z-axis.

Also shown in FIG. 1, the communication system 100 may include a transmission line 190 that electrically couples to the multi-band antenna 108. For example, the transmission line 190 may be a coaxial cable that terminates to a plated thru-hole (not shown) of the printed circuit 104 that is electrically connected to the multi-band antenna 108.

Figure 2:
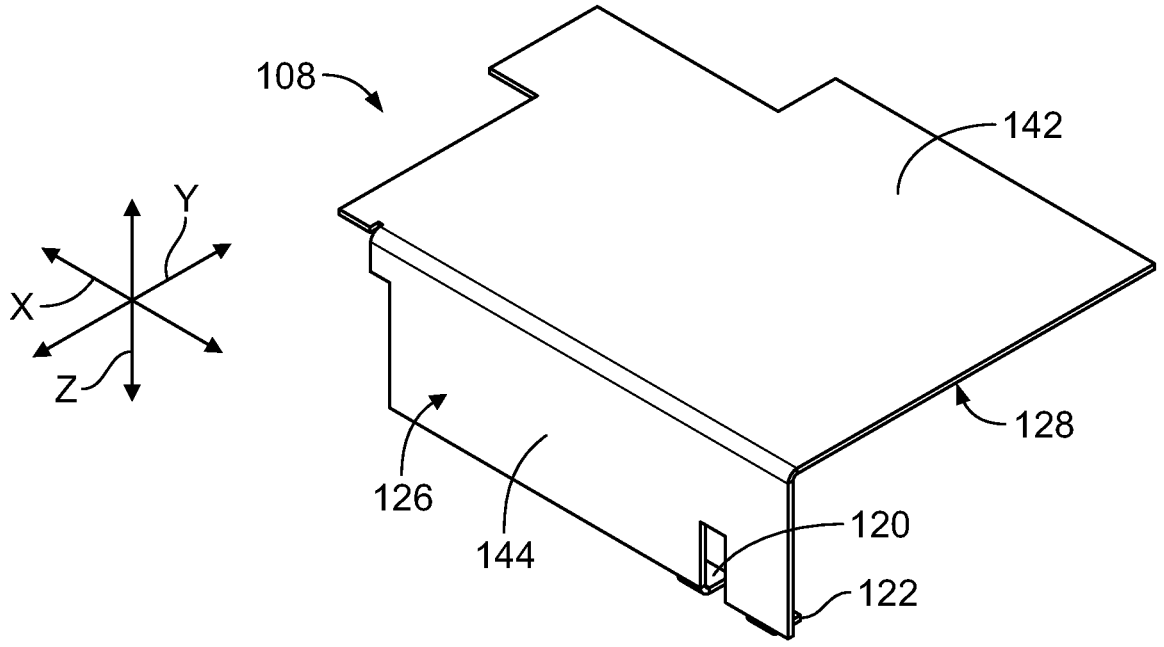
FIG. 2 is a perspective view of a multi-band antenna that may be used with the antenna apparatus of FIG. 1.
Figure 3:
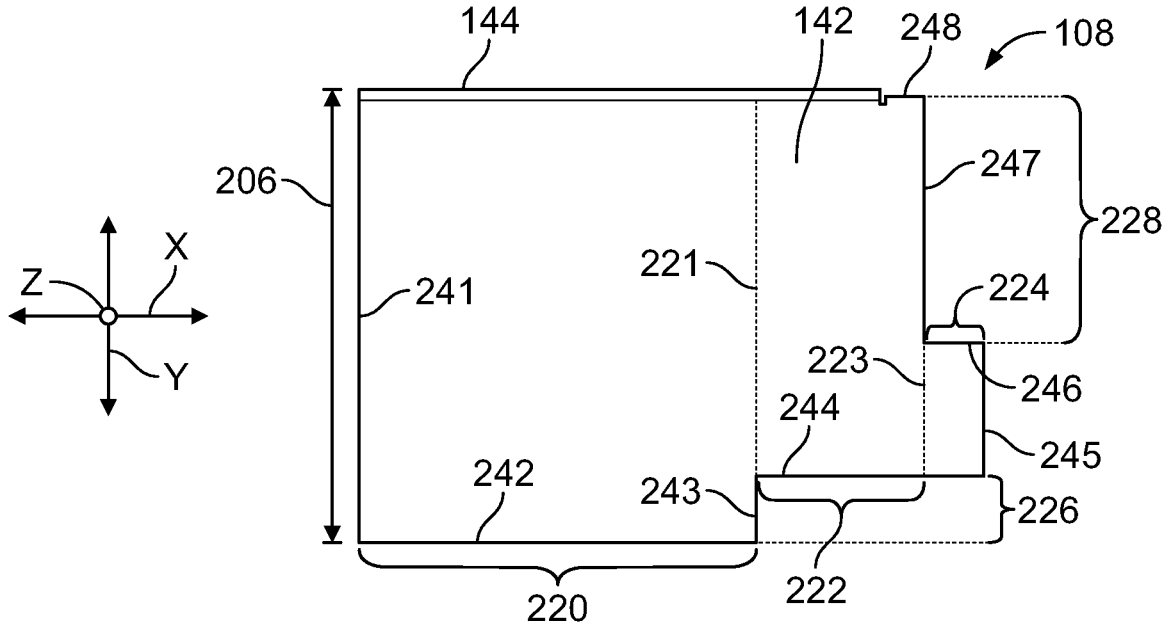
FIG. 3 is a top view of the multi-band antenna that may be used with the antenna apparatus of FIG. 1.
Figure 4:
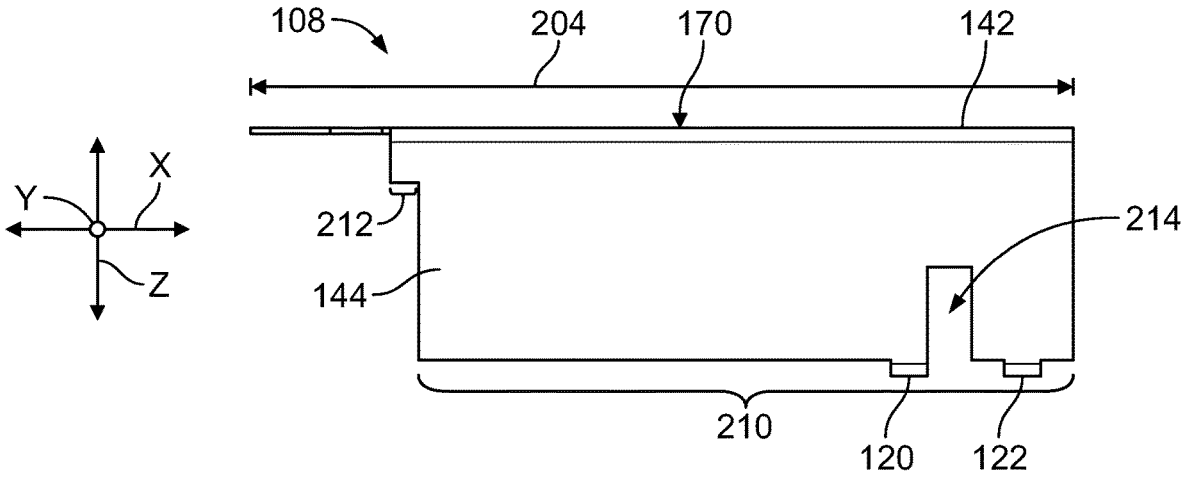
FIG. 4 is a front view of the multi-band antenna that may be used with the antenna apparatus of FIG. 1.
Figure 5:
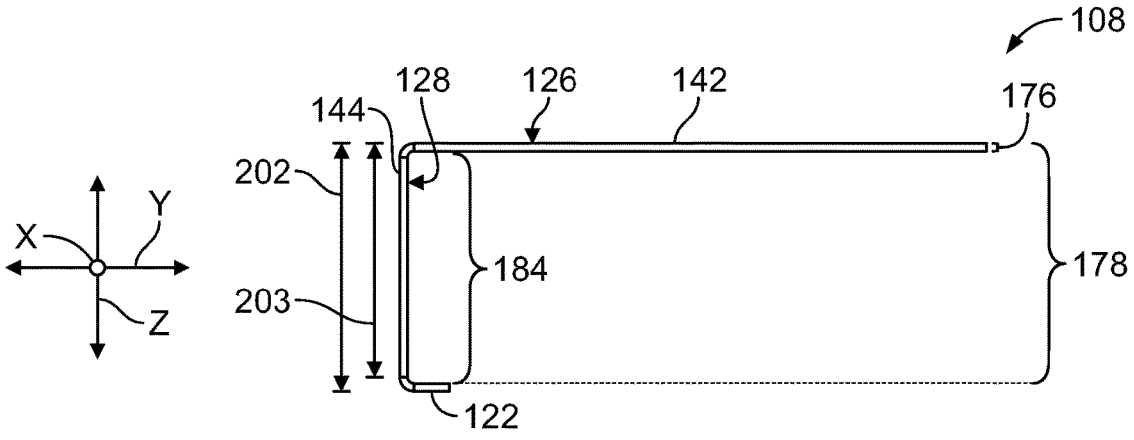
FIG. 5 is a side view of the multi-band antenna that may be used with the antenna apparatus of FIG. 1.

FIGS. 2-5 illustrates the multi-band antenna 108 in greater detail. More specifically, FIG. 2 is a perspective view of the multi-band antenna 108, FIG. 3 is a top view of the multi-band antenna 108, FIG. 4 is a front view of the multi-band antenna 108, and FIG. 5 is a side view of the multi-band antenna 108. As shown in FIGS. 2-5, the multi-band antenna 108 is oriented with respect to mutually perpendicular X, Y, and Z-axes. It should be understood that the X, Y, and Z-axes are only used for reference in describing the positional relationship between different sections of the multi-band antenna 108. The X, Y, and Z-axes do not have any particular orientation with respect to gravity.

As described above, the multi-band antenna 108 includes the elevated section 142, the upright section 144, and the feed and ground terminals 120, 122. Each of the elevated and upright sections 142, 144 is essentially planar, although it is contemplated that one or more portions of the sections may extend in different directions. The multi-band antenna 108 may be characterized as a patch antenna. The multi-band antenna 108 has a height 202 (FIG. 5) that extends along the Z-axis, a width 204 (FIG. 4) that extends along the X-axis, and a length 206 (FIG. 3) that extends along the Y-axis. Also shown, the conductive sheet 114 of the multi-band antenna 108 has a thickness 176 defined between the exterior surface 126 and the interior surface 128.

In particular embodiments, the height 202 is about 17.3 millimeters (mm), the width 204 is about 56.5 mm, and the length 206 is about 41.0 mm. The height 202 includes the feed terminal 120 (FIGS. 2 and 4) and the ground terminal 122 (FIGS. 2, 4, and 5). A height 203 (FIG. 5), which does not include the feed and ground terminals 120, 122, may be about 16.2 mm. The thickness 176 may be, for example, about 0.9 mm. It should be understood, however, that embodiments may have other dimensions than those provided above.

The elevated section 142 and the upright section 144 are shaped to enable the multi-band antenna 108 to communicate within multiple bands. For example, as shown in FIG. 3, the elevated section 142 includes a main portion 220, a major extension 222, and a minor extension 224. A dashed line 221 extends between the main portion 220 and the major extension 222, and a dashed line 223 extends between the major extension 222 and the minor extension 224. The main portion 220 extends an entirety of the length 206. The main portion 220 and the major extension 222 differ by a cut-out 226. The major extension 222 and the minor extension 224 differ by a cut-out 228.

The elevated section 142 includes outer section edges 241-248, which define a profile of the elevated section 142. The outer section edge 241 extends from the fold line 170 along the Y-axis to the outer section edge 242, The outer section edge 242 extends along the X-axis to the outer section edge 243, which extends along the Y-axis back to the outer section edge 244. The outer section edge 244 extends along the X-axis to the outer section edge 245, which extends along the Y-axis to an outer section edge 246. The outer section edge 246 extends along the X-axis to the outer section edge 247, which extends along the Y-axis to the outer section edge 248. The outer section edge 248 extends to the upright section 144.

The main portion 220 is defined by the outer section edges 241, 242, 243 and the dashed line 221. The major extension 222 is defined by the outer section edges 244, 247 and the dashed line 223. The minor extension 224 is defined by the outer section edges 244, 245, 246 and the dashed line 223. The main portion 220, the major extension 222, and the minor extension 224 are sized and shaped relative to the upright section 144 to achieve a designated performance. For example, the multi-band antenna 108 may communicate through one or more center frequencies within the range of 790-950 MHz, one or more center frequencies within the range of 1700-1900 MHz, and/or one or more center frequencies within the range of 2500-2750 MHz.

As shown in FIG. 4, the upright section 144 includes a main portion 210 and a section extension 212. The main portion 210 includes a section slot 214 that is positioned between the feed and ground terminals 120, 122. The section extension 212 extends laterally away from the main portion 210 and along the fold line 170.

With respect to FIG. 5, the interior surface 128 along the elevated section 142 and along the upright section 144 defines a space 178 (hereinafter referred to as "receiving space"). The receiving space 178 is sized and shaped to have the dielectric carrier 110 disposed therein. In particular embodiments, at least one of the feed terminal 120 or the ground terminal 122 may extend in the loading direction 140 such that the dielectric carrier 110 may be fitted (e.g., snug-fit or interference fit) within a grip space 184 defined between the at least one terminal and the interior surface 128 of the elevated section 142.

Figure 6:
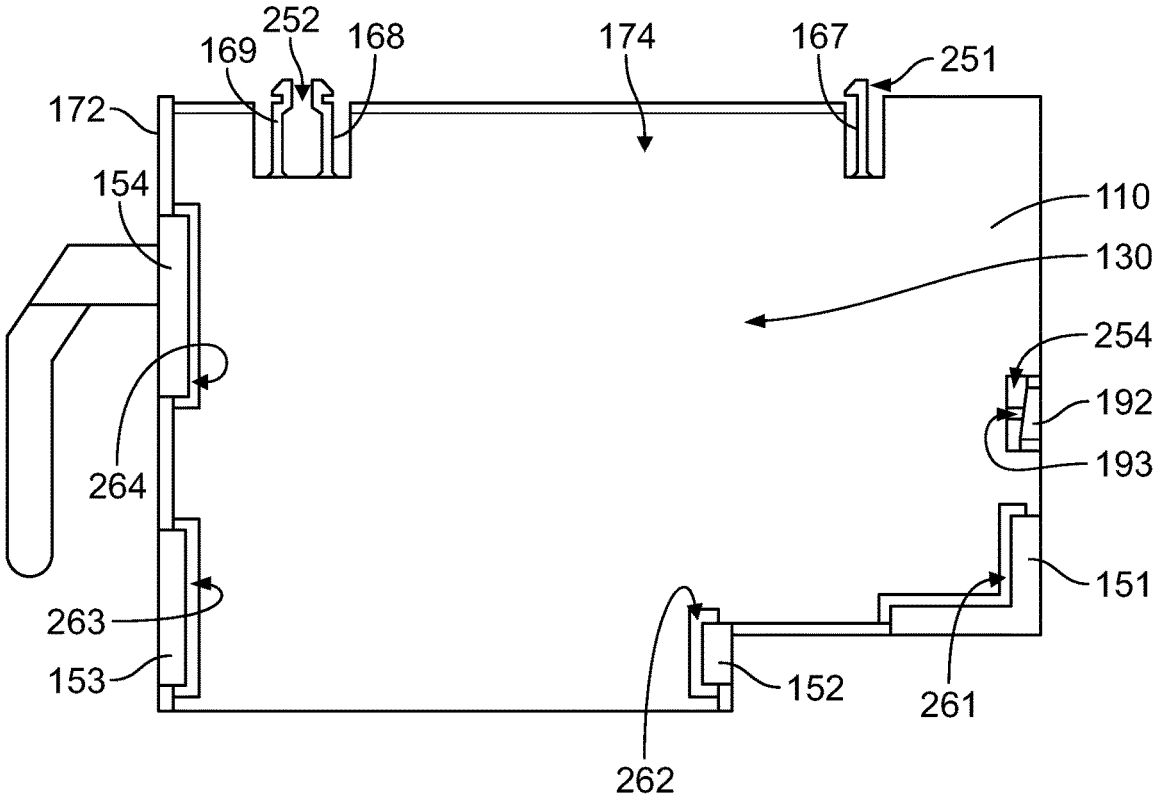
FIG. 6 is an isolated top view of a dielectric carrier that may be used with the antenna apparatus of FIG. 1 to hold the multi-band antenna.
Figure 7:
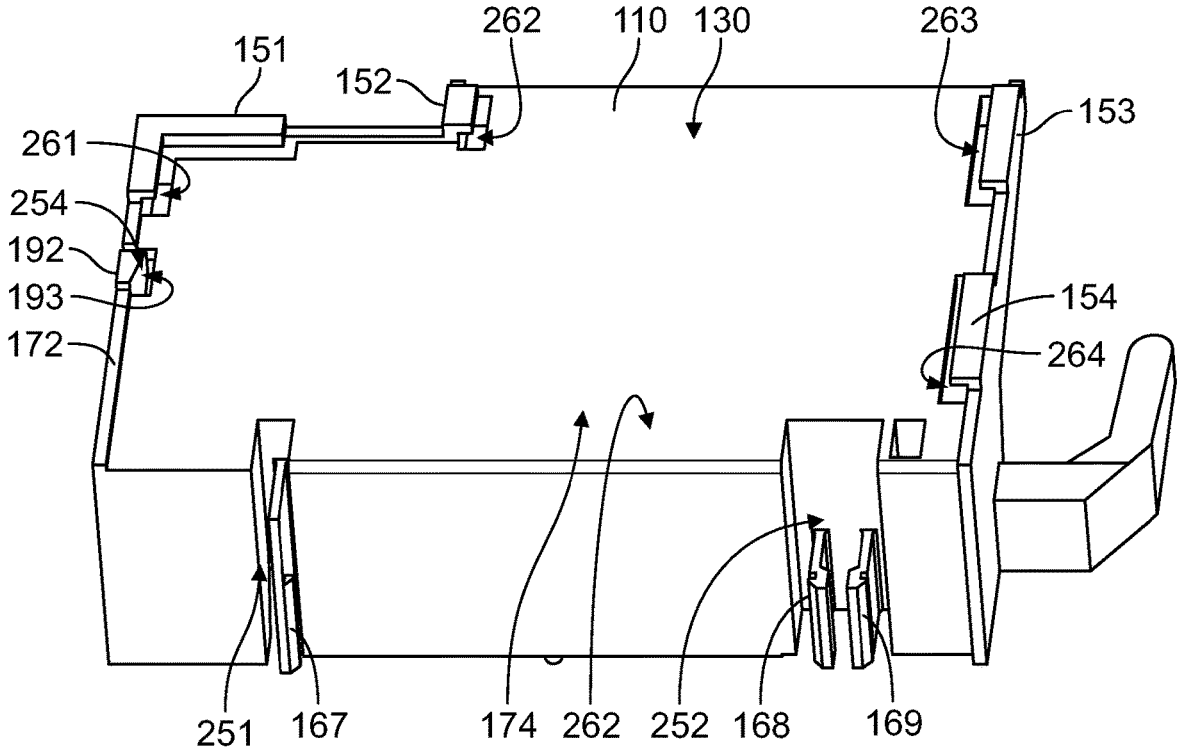
FIG. 7 is a perspective view of the dielectric carrier that may be used with the antenna apparatus of FIG. 1.

FIG. 6 is a view of the top side 130 of the dielectric carrier 110, and FIG. 7 is a perspective view of the dielectric carrier 110. The conductive sheet 114 (FIG. 1) is not shown in FIGS. 6 and 7. The locking projection 167 is positioned within a projection recess 251, and the locking projections 168, 169 are positioned within a projection recess 252. The projection recesses 251-252 are sized and shaped to enable the respective locking projections 167-169 to deflect when the conductive sheet 114 is loaded onto the dielectric carrier 110.

The dielectric carrier 110 also includes a locking projection 192. The locking 192 is tab-shaped, but may have different shapes in other embodiments. The locking projection 192 includes a portion of a guide surface 193 that defines the platform space 174. The ledge 172 may also define a guide surface. The locking projection 192 is configured to be deflected laterally away from the platform space 174. More specifically, the locking projection 192 may be deflected laterally away from the platform space 174 as the elevated section 142 (FIG. 1) of the multi-band antenna 108 (FIG. 1) engages the locking projection 192. The locking projection 192 is positioned within a projection recess 254. The projection recess 254 is sized and shaped to enable the locking projection 192 to deflect a sufficient amount when the conductive sheet 114 is loaded onto the dielectric carrier 110.

Also shown, the dielectric carrier 110 may include channels 261-264 through the elevated side 130 of the dielectric carrier 110. The channels 261-264 align with the guide projections 151-154, respectively. The channels 261-264 may reduce an amount of friction between the dielectric carrier 110 and the conducive sheet 114. The channels 261-264 may also be sized and shaped to achieve a designated performance for the antenna apparatus 102.

Figure 8:
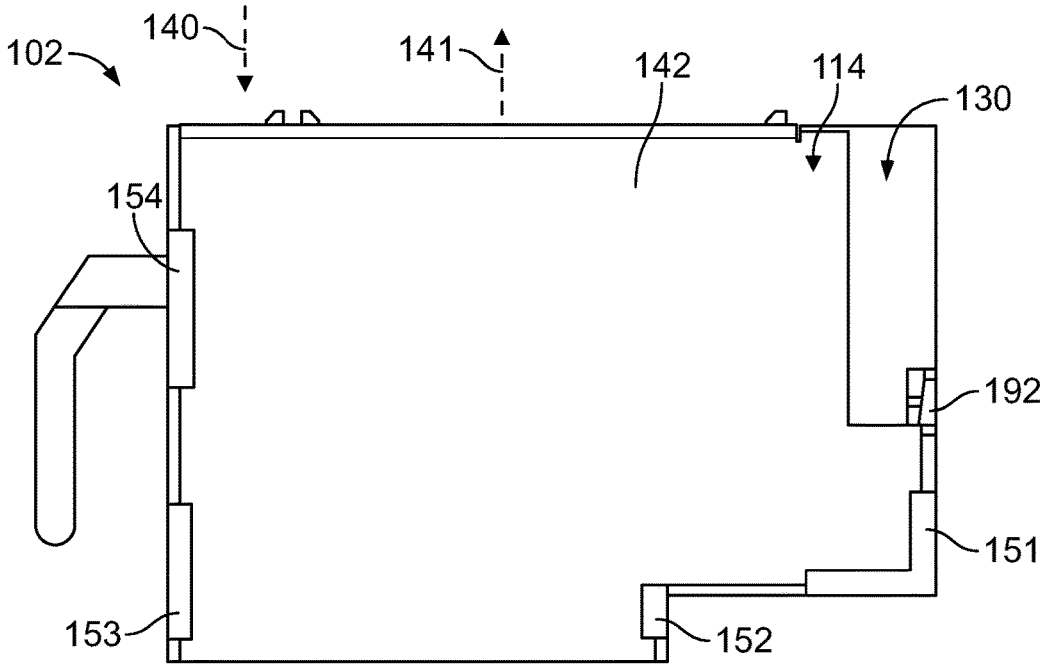
FIG. 8 is a top view of the antenna apparatus of FIG. 1 illustrating a top of the antenna apparatus.

FIG. 8 is a top view of the antenna apparatus 102 showing the top side 130 and the elevated section 142 of the conductive sheet 114. As shown, the elevated section 142 is positioned below the guide projections 151-154 of the dielectric carrier 110. The dielectric carrier 110 is shown as partially transparent in FIG. 8. The locking projection 192 is positioned such that the locking projection 192 may block the conductive sheet 114 from moving in an unloading direction 141 that is opposite the loading direction 140.

Figure 9:
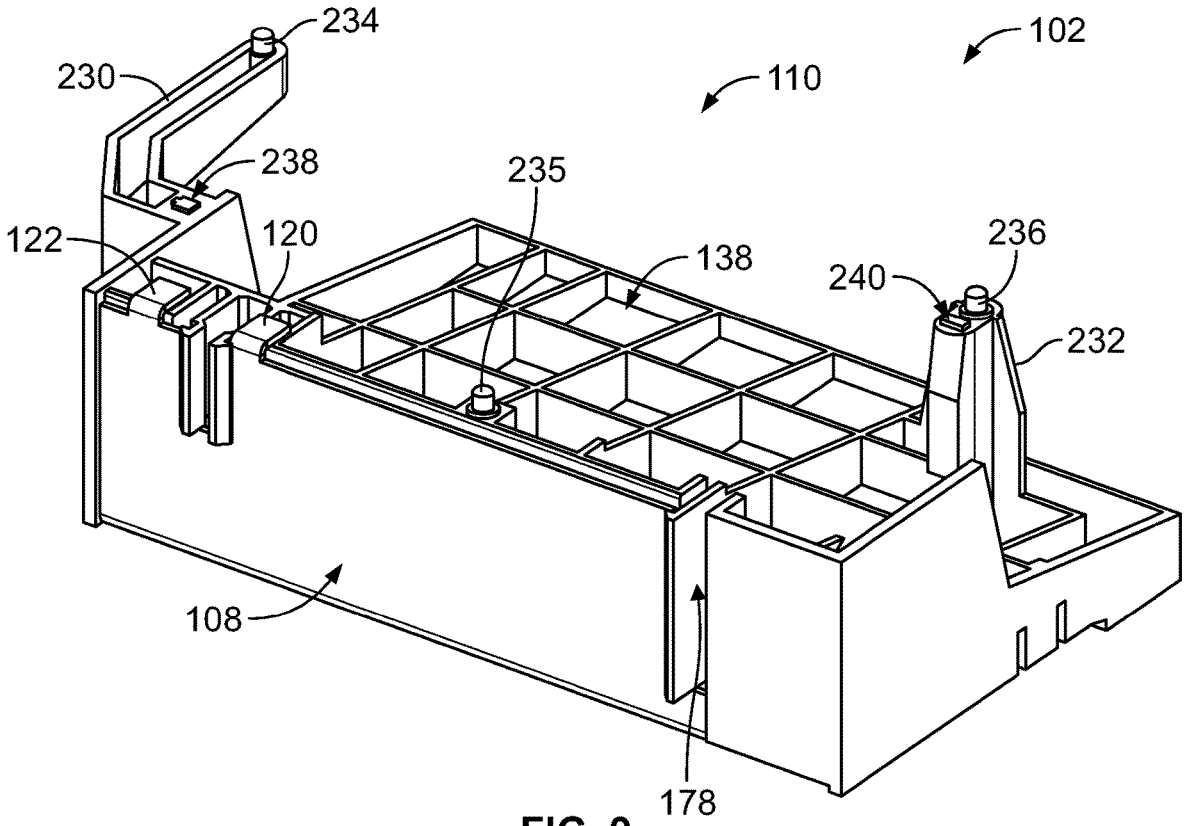
FIG. 9 is a perspective view of the antenna apparatus of FIG. 1 illustrating a bottom of the dielectric carrier.

FIG. 9 is a bottom perspective view of the antenna apparatus 102. As shown, the dielectric carrier 110 is disposed within the receiving space 178 defined by the multi-band antenna 108. The dielectric carrier 110 includes legs 230, 232. The legs 230, 232 permit additional space under the dielectric carrier 110 or antenna apparatus 102 so that other components may be mounted to the printed circuit 104. The legs 230, 232 are configured to engage the mounting side 180 (FIG. 1) of the printed circuit 104 (FIG. 1). Optionally, the legs 230, 232 may have respective posts 234, 236 that are sized and shaped to be inserted into holes (not shown) of the printed circuit 104 for mounting the antenna apparatus 102. The dielectric carrier 110 also has a post 235 that is positioned along the side wall 132. The legs 230, 232, the side wall 132, and the end sides 134, 136 are positioned and shaped to provide balance to the dielectric carrier 110 (or antenna apparatus 102) when mounted to the printed circuit 104. The posts 234-236 are configured to mechanically hold the antenna apparatus 102 to the printed circuit 104 prior to a reflow process.

In some embodiments, the underside 138 of the dielectric carrier 110 may include solder pads 238, 240 for mechanically securing the dielectric carrier 110 to the printed circuit 104. In the illustrated embodiment, the solder pads 238, 240 do not form a communication pathway but may be configured to communicate signals in other embodiments. Also shown in FIG. 9, the feed terminal 120 and the ground terminal 122 may grip the underside 138 of the dielectric carrier 110.

Figure 10:
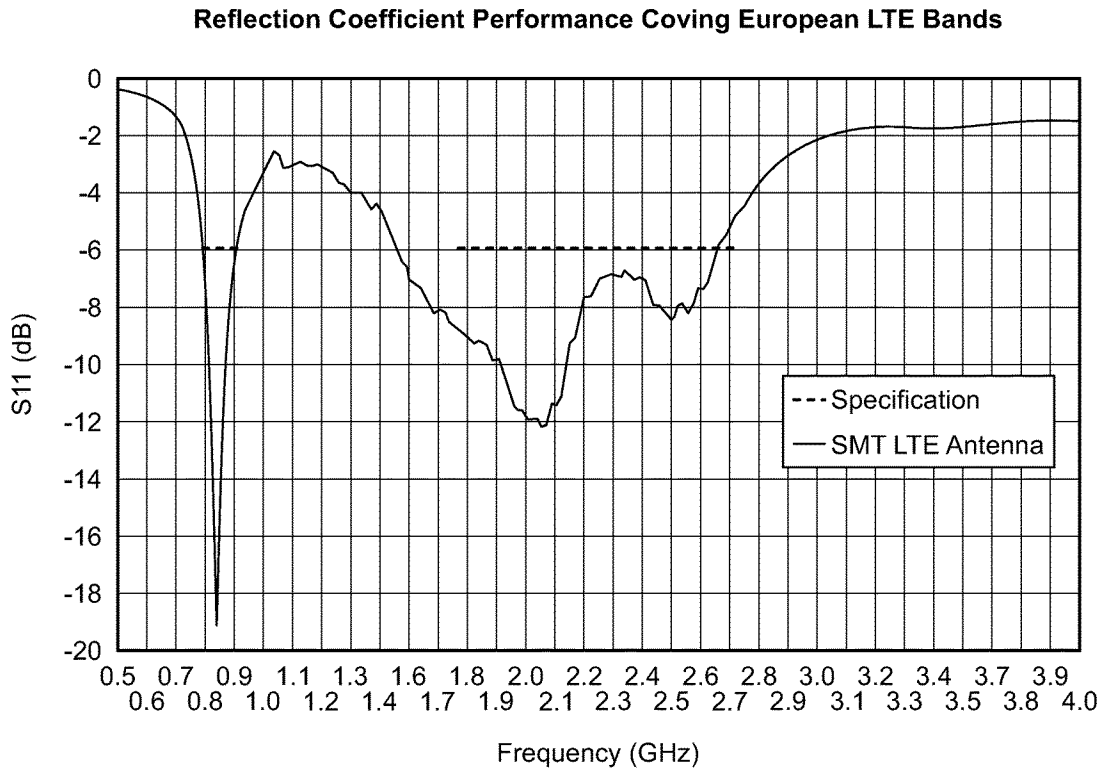
FIG. 10 is a graph illustrating return loss of an antenna apparatus formed in accordance with an embodiment over a wide range of frequencies.

FIG. 10 is a graph illustrating a reflection coefficient by multi-band antenna that was formed in accordance with an embodiment. More specifically, an antenna apparatus, such as the multi-band antenna 108 (FIG. 1), was tested through a range of frequencies (0.5 GHz to 4.5 GHz). Between about 790-950 MHz, the reflection coefficient was less than −6.0 dB. Between about 1500-2700 MHz, the reflection coefficient was less than −6.0 dB. Accordingly, embodiments provide an antenna that is capable of performing effectively within multiple RF bands.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f), unless and until such claim limitations expressly use the phrase "means for" followed by a statement of function void of further structure.

What is claimed is:

1. An antenna apparatus comprising:

a dielectric carrier having a first side and a second side; and a multi-band antenna having an interior surface and an exterior surface, the multi-band antenna comprising a first section and a second section that are bent with respect to one another;

wherein the interior surface along the first and second sections defines a receiving space, the dielectric carrier being disposed within the receiving space such that the first section is positioned along the first side of the dielectric carrier and the second section is positioned along the second side of the dielectric carrier, the dielectric carrier including at least one projection that covers a portion of the exterior surface of the multi-band antenna;

wherein the at least one projection includes multiple locking projections, wherein at least one locking projection extends away from the dielectric carrier, the at least one locking projection including a grip surface that opposes and covers the portion of the exterior surface.

2. The antenna apparatus of claim 1, wherein the locking projection is deflectable to allow the multi-band antenna to be positioned alongside the dielectric carrier.

3. The antenna apparatus of claim 2, wherein the second section includes a section slot defined by an inner edge of the second section, the locking projection extending through the section slot away from the second side.

4. The antenna apparatus of claim 1, wherein the at least one projection also includes:

a guide projection that is spaced apart from and extends along a surface of the dielectric carrier, the guide projection defining a receiving slot between the guide projection and the surface of the dielectric carrier, the receiving slot being sized to receive a thickness of a conductive sheet of the multi-band antenna;

wherein the guide projection extends along the first side and the locking projection extends away from the second side, wherein the multi-band antenna and the dielectric carrier are shaped relative to each other such that the first section is received within the receiving slot and the second section deflects the locking projection when the multi-band antenna is moved in a loading direction.

5. The antenna apparatus of claim 4, wherein the antenna apparatus has a height that is less than twenty millimeters.

6. The antenna apparatus of claim 1, wherein the multi-band antenna includes a section slot defined by opposing portions of an inner edge, the locking projection extending through the section slot.

7. The antenna apparatus of claim 1, wherein the locking projection is deflectable from a deflected position, in which the grip surface does not oppose and cover the portion of the exterior surface, and an undeflected position in which the grip surface opposes and covers the portion of the exterior surface.

8. The antenna apparatus of claim 1, wherein the first section and the second section are coupled to each other along a fold line, the second section having a maximum width extending along an entirety of the fold line.

9. The antenna apparatus of claim 1, wherein the first section has a main portion that includes a majority of an area of the exterior surface of the first section, the multi-band antenna being bent along a fold line, wherein the second section extends continuously along the fold line for an entire width of the main portion.

10. The antenna apparatus of claim 1, wherein the first and second sections respectively include substantial portions of the exterior surface that determine multiple frequency bands of the multi-band antenna.

11. The antenna apparatus of claim 1, wherein the first section and the second section are coupled to each other along a fold line, the second section having a cut-out defined by an inner edge, the second section including a portion of the inner edge that is closest to the fold line but is located a distance away from the fold line.

12. An antenna apparatus comprising:

a dielectric carrier having a first side and a second side; and a multi-band antenna having an interior surface and an exterior surface, the multi-band antenna comprising a first section and a second section that are bent with respect to one another;

wherein the interior surface along the first and second sections defines a receiving space, the dielectric carrier being disposed within the receiving space such that the first section is positioned along the first side of the dielectric carrier and the second section is positioned along the second side of the dielectric carrier, the dielectric carrier including at least one projection that covers a portion of the exterior surface of the multi-band antenna, the at least one projection including multiple locking projections;

wherein the multi-band antenna includes a feed terminal and a ground terminal extending from the second section, the feed terminal and the ground terminal defining a terminal width measured along an X-axis, wherein the terminal width is less than a width of the second section measured along the X-axis.

13. The antenna apparatus of claim 12, wherein the at least one projection also includes a guide projection that is spaced apart from and extends along a surface of the dielectric carrier, the guide projection defining a slot between the guide projection and the surface of the dielectric carrier, the slot being sized to receive a thickness of a conductive sheet of the multi-band antenna.

14. The antenna apparatus of claim 12, wherein the at least one projection includes multiple guide projections, the guide projections covering portions of an outer perimeter of the first section, the at least one locking projection covering a portion of an inner perimeter of the second section, the inner perimeter defining a section slot through which the at least one locking projections extends.

15. An antenna apparatus comprising:

a dielectric carrier having a first side and a second side, the dielectric carrier including a guide projection and a locking projection; and a multi-band antenna having an interior surface, an exterior surface, and an edge that extends between the interior and exterior surfaces, the interior and exterior surfaces facing in opposite directions, the multi-band antenna comprising a first section and a second section that are bent with respect to one another;

wherein the dielectric carrier is positioned within a receiving space of the multi-band antenna, the receiving space being defined by the interior surface along the first and second sections of the multi-band antenna, the first section of the multi-band antenna being positioned along the first side of the dielectric carrier, the second section of the multi-band antenna being positioned along the second side of the dielectric carrier;

wherein the guide projection and the locking projection are configured to hold the multi-band antenna to the dielectric carrier, the guide projection facing the exterior surface of the multi-band antenna and blocking movement of the first section of the multi-band antenna in a first direction away from and perpendicular to the first side of the dielectric carrier, the locking projection facing the multi-band antenna and blocking movement of the second section of the multi-band antenna in a second direction away from the second side of the dielectric carrier; and wherein the first and second directions are perpendicular to each other and the locking projection is configured to move between a deflected position and an undeflected position when the multi-band antenna is loaded onto the dielectric carrier.

16. The antenna apparatus of claim 15, wherein the multi-band antenna and the dielectric carrier are shaped relative to each other such that, during a loading operation in which the multi-band antenna moves in a loading direction that is opposite the second direction, the first section of the multi-band antenna slides along the first side of the dielectric carrier within a slot defined by the guide projection and the second section of the multi-band antenna approaches the second side of the dielectric carrier, the multi-band antenna deflecting the locking projection during the loading operation.

17. The antenna apparatus of claim 15, wherein the multi-band antenna further comprises a terminal that extends from the second section in the loading direction, the dielectric carrier being positioned within a grip space that is defined between the interior surface of the first section and a surface of the terminal that opposes the interior surface of the first section.

18. The antenna apparatus of claim 15, wherein the first side of the dielectric carrier includes a ledge, the ledge interfacing with the edge of the multi-band antenna along the first section and blocking movement of the multi-band antenna in a third direction that is perpendicular to the first and second directions.

19. The antenna apparatus of claim 18, wherein the locking projection includes a guide surface, the ledge and the guide surface defining a platform space along the first side of the dielectric carrier, the locking projection being deflectable laterally away from the platform space.

20. The antenna apparatus of claim 15, wherein the locking projection is in the deflected position during a loading operation and moves toward the undeflected position after the multi-band antenna clears the locking projection.

* * * * *